US008736637B2

(12) United States Patent
Rao

(10) Patent No.: US 8,736,637 B2
(45) Date of Patent: May 27, 2014

(54) APPARATUS AND METHOD FOR GENERATING CHOPPER-STABILIZED SIGNALS

(75) Inventor: Yong-Nien Rao, Hsinchu (TW)

(73) Assignee: Raydium Semiconductor Corporation, Hsinchu (TW)

( * ) Notice: Subject to any disclaimer, the term of this patent is extended or adjusted under 35 U.S.C. 154(b) by 1260 days.

(21) Appl. No.: 11/905,795

(22) Filed: Oct. 4, 2007

(65) Prior Publication Data

US 2008/0084409 A1 Apr. 10, 2008

(30) Foreign Application Priority Data

Oct. 5, 2006 (TW) ..... 95137213 A

(51) Int. Cl.
*G09G 5/10* (2006.01)

(52) U.S. Cl.
USPC ..... 345/690; 345/54; 345/55

(58) Field of Classification Search
USPC ..... 345/690, 54–55
See application file for complete search history.

(56) References Cited

U.S. PATENT DOCUMENTS

2006/0017680 A1 1/2006 Chen et al.

OTHER PUBLICATIONS

Abstract of Japanese Publication JP-2002/182624, Jun. 2002, Su Feng-Cheng.*

* cited by examiner

*Primary Examiner* — William Boddie
*Assistant Examiner* — Leonid Shapiro

(57) ABSTRACT

A method for generating chopper-stabilized signals includes the following steps. First, a voltage polarity control signal is received. Next, the voltage polarity control signal is sampled to obtain a sampling signal, and a voltage transformation manner of the voltage polarity inversion of the voltage polarity control signal is judged according to the sampling signal. Then, a frame transformation signal template is obtained according to the voltage transformation manner of the voltage polarity inversion of the voltage polarity control signal and the sampling signal. Next, the frame transformation signal template is compared with the sampling signal and a frame transformation signal is generated. Then, a first chopper-stabilized signal is outputted according to the frame transformation signal and the voltage polarity control signal.

10 Claims, 10 Drawing Sheets

200

| Frame time period / Row | 1 | 2 | 3 | 4 |
|---|---|---|---|---|
| 1 | A | B | A | B |
| 2 | A | B | A | B |
| 3 | A | B | A | B |
| 4 | A | B | A | B |
| ⋮ | ⋮ | ⋮ | ⋮ | ⋮ |
| 1069 | A | B | A | B |
| 1070 | A | B | A | B |
| 1071 | A | B | A | B |
| 1072 | A | B | A | B |

FIG. 2(PRIOR ART)

300

| Frame time period / Row | 1 | 2 |
|---|---|---|
| 1 | P | N |
| 2 | P | N |
| 3 | N | P |
| 4 | N | P |
| ⋮ | ⋮ | ⋮ |
| 1069 | P | N |
| 1070 | P | N |
| 1071 | N | P |
| 1072 | N | P |

FIG. 3A

300

| Frame time period / Row | 1 | 2 |
|---|---|---|
| 1 | P | N |
| 2 | N | P |
| 3 | P | N |
| 4 | N | P |
| ⋮ | ⋮ | ⋮ |
| 1069 | P | N |
| 1070 | N | P |
| 1071 | P | N |
| 1072 | N | P |

FIG. 3B

500

| Row \ Frame time period | 1 | | 2 | | 3 | | 4 | |
|---|---|---|---|---|---|---|---|---|
| | POL | CHOP | POL | CHOP | POL | CHOP | POL | CHOP |
| 1 | P | A | N | A | P | B | N | A |
| 2 | N | A | P | A | N | B | P | A |
| 3 | P | A | N | A | P | B | N | A |
| 4 | N | A | P | A | N | B | P | A |
| 5 | P | A | N | B | P | A | N | B |
| 6 | N | A | P | B | N | A | P | B |
| ⋮ | ⋮ | ⋮ | ⋮ | ⋮ | ⋮ | ⋮ | ⋮ | ⋮ |
| 1067 | P | A | N | B | P | A | P | B |
| 1068 | N | A | P | B | N | A | N | B |
| 1069 | P | A | N | B | P | A | P | B |
| 1070 | N | A | P | B | N | A | N | B |
| 1071 | P | A | N | B | P | A | P | B |
| 1072 | N | A | P | B | N | A | N | B |

FIG. 5A

500

| Frame time period / Row | 1 | | 2 | | 3 | | 4 | |
|---|---|---|---|---|---|---|---|---|
| | POL | CHOP | POL | CHOP | POL | CHOP | POL | CHOP |
| 1 | P | A | N | A | P | B | N | A |
| 2 | P | A | N | A | P | B | N | A |
| 3 | N | A | P | A | N | B | P | A |
| 4 | N | A | P | A | N | B | P | A |
| 5 | P | A | N | B | P | A | N | B |
| 6 | P | A | N | B | P | A | N | B |
| ⋮ | ⋮ | ⋮ | ⋮ | ⋮ | ⋮ | ⋮ | ⋮ | ⋮ |
| 1067 | N | A | P | B | N | A | P | B |
| 1068 | N | A | P | B | N | A | P | B |
| 1069 | P | A | N | B | P | A | N | B |
| 1070 | N | A | N | B | P | A | N | B |
| 1071 | P | A | P | B | N | A | P | B |
| 1072 | N | A | P | B | N | A | P | B |

FIG. 5B

500

| Frame time period / Row | 1 | | 2 | | 3 | | 4 | |
|---|---|---|---|---|---|---|---|---|
| | POL | CHOP | POL | CHOP | POL | CHOP | POL | CHOP |
| 1 | P | A | N | A | P | B | N | B |
| 2 | P | B | N | B | P | A | N | A |
| 3 | N | A | P | B | N | B | P | A |
| 4 | N | B | P | A | N | A | P | B |
| 5 | P | B | N | B | P | A | N | A |
| 6 | P | A | N | A | P | B | N | B |
| ⋮ | ⋮ | ⋮ | ⋮ | ⋮ | ⋮ | ⋮ | ⋮ | ⋮ |
| 1061 | P | B | N | B | P | A | N | A |
| 1062 | P | A | N | A | P | B | N | B |
| 1063 | N | B | P | A | N | A | P | B |
| 1064 | N | A | P | B | N | B | P | A |
| 1065 | P | A | N | A | P | B | N | B |
| 1066 | P | B | N | B | P | A | N | A |

FIG. 5C

APPARATUS AND METHOD FOR GENERATING CHOPPER-STABILIZED SIGNALS

This application claims the benefit of Taiwan application Serial No. 95137213, filed Oct. 5, 2006, the subject matter of which is incorporated herein by reference.

BACKGROUND OF THE INVENTION

1. Field of the Invention

The invention relates in general to an apparatus and a method for generating chopper-stabilized signals, and more particularly to an apparatus and a method for generating chopper-stabilized signals in a thin-film transistor (TFT) liquid crystal display (LCD) without the use of a start control signal (STV).

2. Description of the Related Art

A chopper-stabilized signal is adopted to improve the problem of the offset voltage in an OP amplifier and also to enhance the uniformity.

FIG. 1 (Prior Art) is a schematic illustration showing a conventional OP amplifier 100. As shown in FIG. 1, the OP amplifier 100 has an output voltage $V_{OA}$ equal to an input voltage $V_I$ plus an offset voltage $V_{os}$(i) in a first chopper-stabilized mode chopper-A, and has an output voltage $V_{OB}$ equal to an input voltage $V_I$ minus the offset voltage $V_{os}$(i) in a second chopper-stabilized mode chopper-B. The OP amplifier 100 is alternately switched between the first chopper-stabilized mode chopper-A and the second chopper-stabilized mode chopper-B. Consequently, the OP amplifier 100 has an average output voltage $V_{AVG}$ equal to the input voltage $V_I$, and the problem of the offset voltage is thus solved.

The method of solving the offset voltage of the OP amplifier according to the chopper-stabilized signal is also applied to a thin-film transistor (TFT) liquid crystal display (LCD) frequently. FIG. 2 (Prior Art) is a simple schematic illustration showing a conventional TFT LCD 200. Referring to FIG. 2, the TFT LCD 200 has many rows of pixels. In FIG. 2, 1072 rows of pixels and four frame time periods are illustrated as an example. Usually, in the application field of the TFT LCD, it is requested that the OP amplifier in each row of pixels has to be kept in the first chopper-stabilized mode chopper-A and the second chopper-stabilized mode chopper-B for the same period of time in at least every four frame time periods. For the purpose of the clear representation, the first chopper-stabilized mode chopper-A is represented by A, and the second chopper-stabilized mode chopper-B is represented by B.

In the first frame time period, the OP amplifiers in all the rows of pixels of the TFT LCD 200 are kept in the first chopper-stabilized mode chopper-A. Then, in the second frame time period, the OP amplifiers in all the rows of pixels are kept in the second chopper-stabilized mode chopper-B. The modes of the OP amplifiers are alternately switched in this manner. After the fourth frame time period, the OP amplifier in each row of pixels is kept in the first chopper-stabilized mode chopper-A and the second chopper-stabilized mode chopper-B for the same period of time, so the problem of the offset voltage is solved and the uniformity is enhanced.

However, the conventional method of switching between the first chopper-stabilized mode chopper-A and the second chopper-stabilized mode chopper-B in the TFT LCD 200 is to distinguish whether the frame time period is changed and thus to perform the switching operation according to a start control signal (STV) outputted from a timing controller (not shown) of the TFT LCD 200 at the beginning of each frame time period. However, some current TFT LCDs do not provide the start control signal. So, the method of solving the offset voltage of the OP amplifier is not completely suitable for all the TFT LCDs.

SUMMARY OF THE INVENTION

The invention is directed to an apparatus and a method for generating chopper-stabilized signals, wherein the problem of the offset voltage may be solved by making an OP amplifier be switched between a first chopper-stabilized mode and a second chopper-stabilized mode according to a voltage polarity control signal provided from a TFT LCD and without according to a start control signal.

According to a first aspect of the present invention, a chopper-stabilized signal generating method is provided. The method includes the following steps. First, a voltage polarity control signal is received. Next, the voltage polarity control signal is sampled to obtain a sampling signal, and a voltage transformation manner of the voltage polarity inversion of the voltage polarity control signal is judged according to the sampling signal. Then, a frame transformation signal template is obtained according to the voltage transformation manner of the voltage polarity inversion of the voltage polarity control signal and the sampling signal. Next, the frame transformation signal template is compared with the sampling signal to generate a frame transformation signal. Then, a first chopper-stabilized signal is outputted according to the frame transformation signal and the voltage polarity control signal.

According to a second aspect of the present invention, a chopper-stabilized signal generating apparatus is provided. The apparatus is applied to a TFT LCD having multiple OP amplifiers and includes a sampling unit, a control unit and a signal generating unit. The sampling unit samples a voltage polarity control signal to obtain a sampling signal, and judges a voltage transformation manner of the voltage polarity inversion of the voltage polarity control signal according to the sampling signal. The control unit is coupled to the sampling unit. The signal generating unit generates a first chopper-stabilized signal or a second chopper-stabilized signal, selects the first chopper-stabilized signal or the second chopper-stabilized signal as a chopper-stabilized signal, and outputs the selected chopper-stabilized signal to the OP amplifiers. After the voltage transformation manner of the voltage polarity inversion of the voltage polarity control signal is judged as a one-line inversion or a two-line inversion, the control unit outputs a first trigger signal, and obtains a frame transformation signal template according to the sampling signal, the signal generating unit compares the frame transformation signal template with the sampling signal to generate a frame transformation signal, and the signal generating unit generates the first chopper-stabilized signal according to the first trigger signal in conjunction with the frame transformation signal and the voltage polarity control signal.

The invention will become apparent from the following detailed description of the preferred but non-limiting embodiment. The following description is made with reference to the accompanying drawings.

BRIEF DESCRIPTION OF THE DRAWINGS

FIG. 2 (Prior Art) is a simple schematic illustration showing a conventional TFT LCD.

FIG. 3A is a schematic illustration showing a two-line inversion in a TFT LCD.

FIG. 3B is a schematic illustration showing a one-line inversion in a TFT LCD.

FIG. 5A is a simple schematic illustration showing a TFT LCD according to the preferred embodiment of the invention.

FIG. 5B is a simple schematic illustration showing another example of the TFT LCD according to the preferred embodiment of the invention.

FIG. 5C is a simple schematic illustration showing still another example of the TFT LCD according to the preferred embodiment of the invention.

DETAILED DESCRIPTION OF THE INVENTION

The invention provides an apparatus and a method for generating chopper-stabilized signals, wherein the problem of the offset voltage may be solved by making an OP amplifier be switched between a first chopper-stabilized mode and a second chopper-stabilized mode according to a voltage polarity control signal provided from a TFT LCD and without according to a start control signal.

A liquid crystal molecule in the TFT LCD cannot be always held on a certain voltage, or otherwise the molecule cannot be rotated to form different gray-scale levels in response to the electric field variation due to the damage to the property thereof. So, the voltage of the molecule has to be recovered every period of time in order to prevent the property of the liquid crystal molecule from being damaged. The display voltage in the TFT LCD may have two polarities including a positive polarity (P) and a negative polarity (N).

A timing controller of the TFT LCD generates a voltage polarity control signal (POL), having many pulses, for controlling the display voltage. In addition, the voltage polarity inversion of the voltage polarity control signal may be a two-line inversion or a one-line inversion. FIG. 3A is a schematic illustration showing a two-line inversion in a TFT LCD 300. As shown in FIG. 3A, the display voltage of the TFT LCD 300 is inverted every two rows of pixels. FIG. 3B is a schematic illustration showing a one-line inversion in a TFT LCD. As shown in FIG. 3B, the display voltage of the TFT LCD 300 is inverted every one row of pixels.

Figure 1:
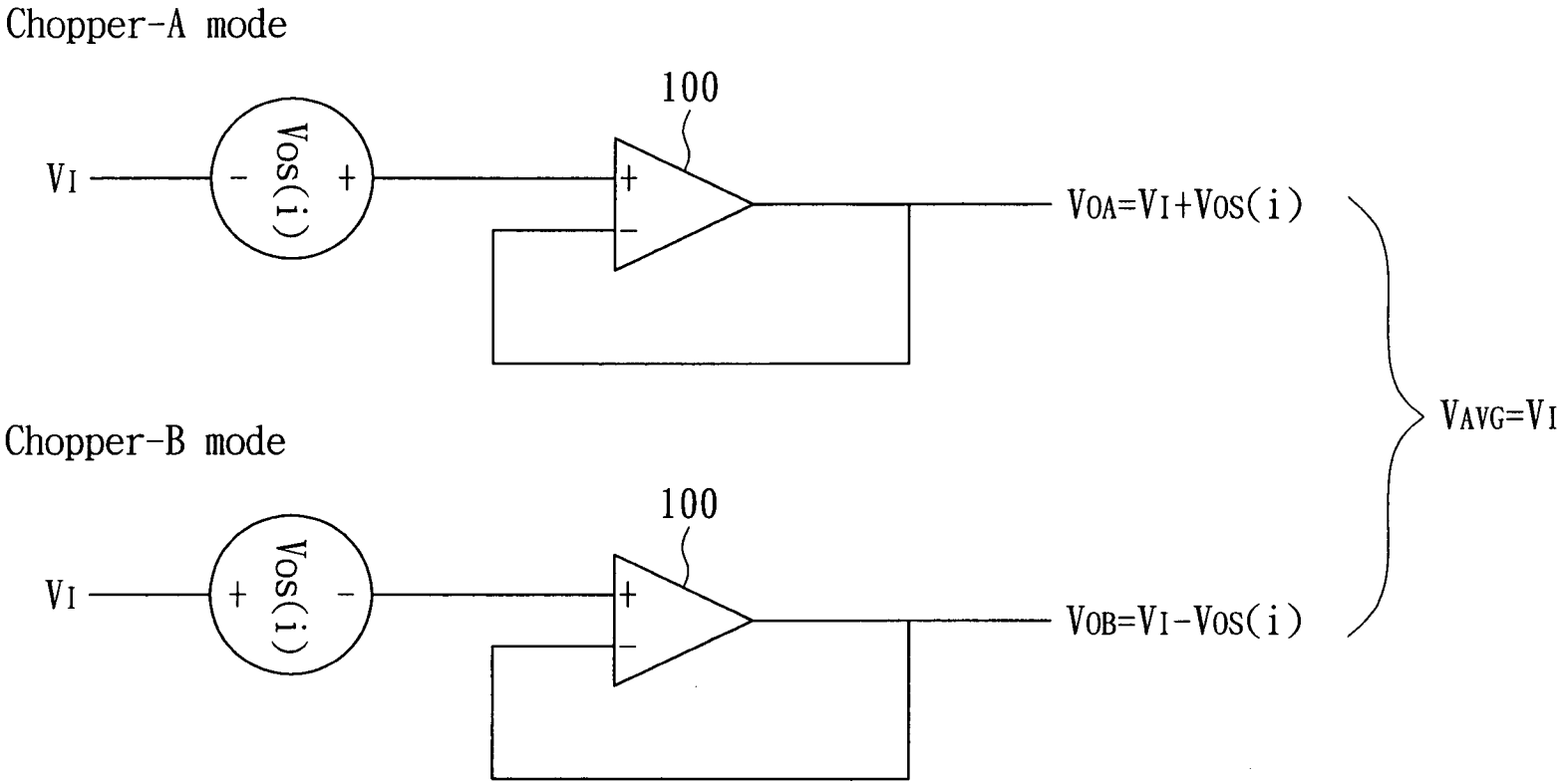
FIG. 1(PRIOR ART)
FIG. 1 (Prior Art) is a schematic illustration showing a conventional OP amplifier.
Figure 4A:
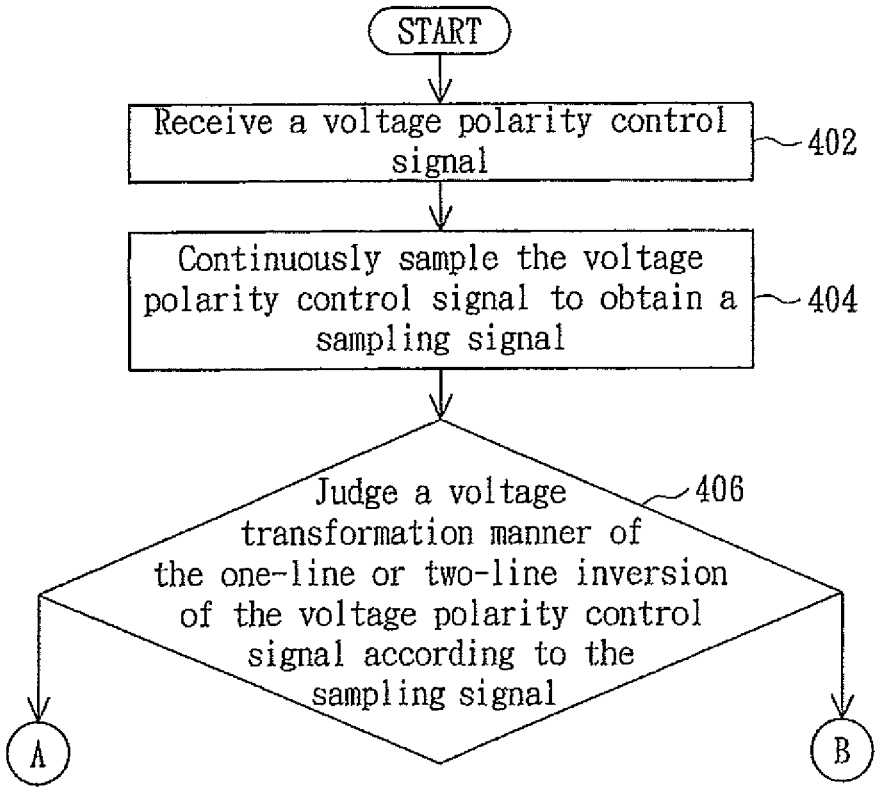
FIG. 4A and FIG. 4B are a flow chart showing a method for generating chopper-stabilized signals according to a preferred embodiment of the invention.
Figure 4B:
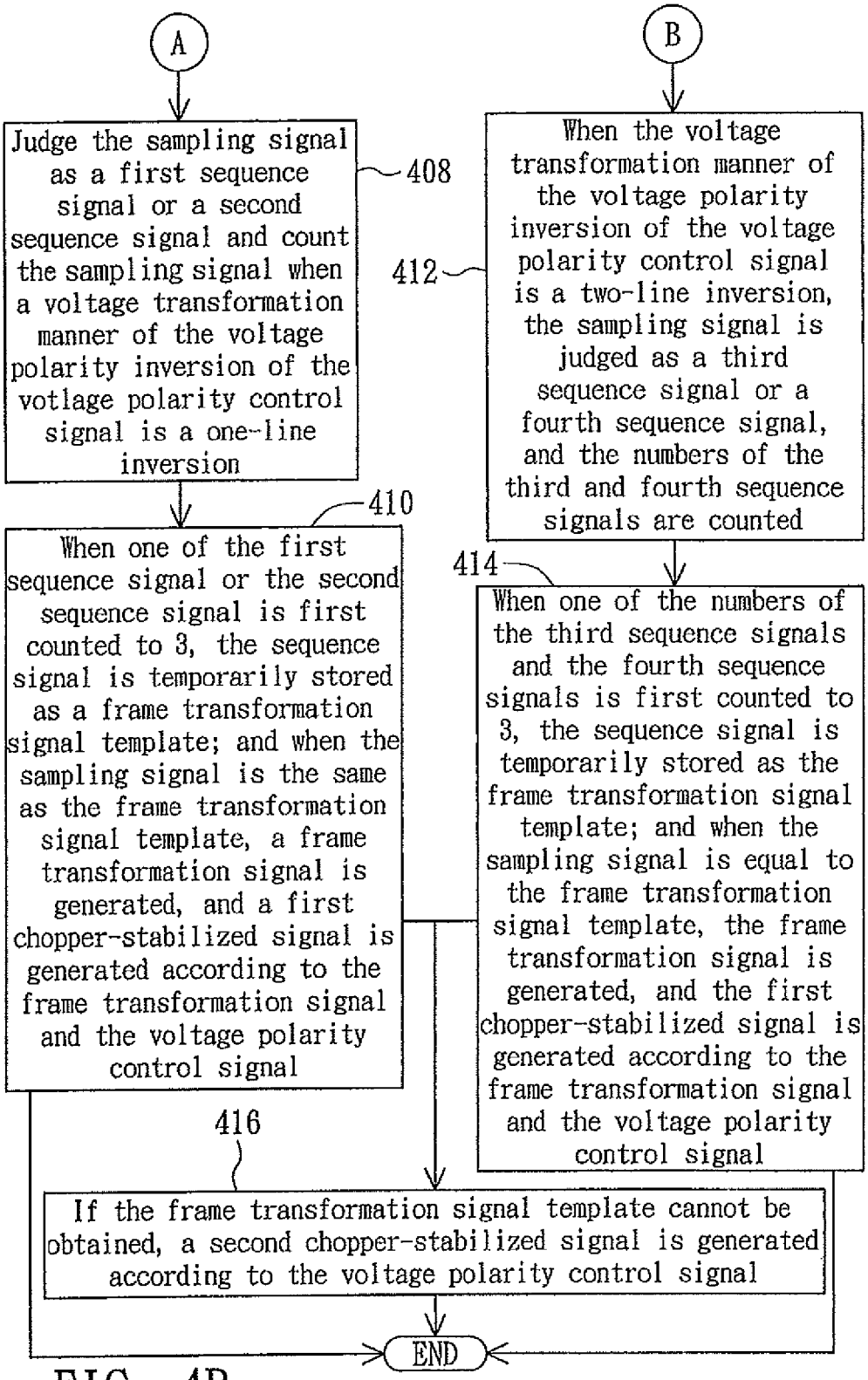

FIG. 4A and FIG. 4B are a flow chart showing a method for generating chopper-stabilized signals according to a preferred embodiment of the invention. As shown in FIG. 4A and FIG. 4B, this method is applied to a TFT LCD having many OP amplifiers. First, in step 402, a voltage polarity control signal (POL) is received. Next, in step 404, continuous n pulses of the voltage polarity control signal are continuously sampled to obtain a sampling signal, wherein n is a positive integer and is usually equal to 8. That is, continuous eight pulses are continuously sampled to obtain the sampling signal. Then, in step 406, the voltage transformation manner of the one-line or two-line inversion of the voltage polarity control signal is judged according to the sampling signal.

In step 408, when the manner of voltage transformation of the voltage polarity inversion of the voltage polarity control signal is the one-line inversion, the sampling signal is judged as a first sequence signal or a second sequence signal, and the numbers of the first sequence signals and the second sequence signals (i.e., the number of occurrences of the first sequence signal and the number of occurrences of the second sequence signal) are counted. Thereafter, in step 410, when one of the numbers of the first sequence signals and the second sequence signals is first counted to 3, the sequence signal is temporarily stored as a frame transformation signal template. When the sampling signal is the same as the frame transformation signal template, a frame transformation signal is generated, and a first chopper-stabilized signal is generated in conjunction with the frame transformation signal and the voltage polarity control signal. The first chopper-stabilized signal makes the OP amplifiers of the TFT LCD be properly and alternately switched between the first chopper-stabilized mode chopper-A and the second chopper-stabilized mode chopper-B so that the offset voltage is eliminated. FIG. 5A is a simple schematic illustration showing a TFT LCD 500 according to the preferred embodiment of the invention. As shown in FIG. 5A, the manner of voltage transformation of the voltage polarity inversion of the TFT LCD 500 is the one-line inversion, wherein "POL" represents the polarity of the voltage polarity control signal of the corresponding row of pixels, "P" represents the positive polarity, "N" represents the negative polarity, and "CHOP" represents the chopper-stabilized mode of the OP amplifier of the corresponding row of pixels. The first sequence signal and the second sequence signal are defined as any two combinations exclusive of PNPNPNPN or NPNPNPNP.

In step 412, when the manner of voltage transformation of the voltage polarity inversion of the voltage polarity control signal is the two-line inversion, the sampling signal is judged as a third sequence signal or a fourth sequence signal and the numbers of the third sequence signals and the fourth sequence signals (i.e., the number of occurrences of the third sequence signal and the number of occurrences of the fourth sequence signal) are counted. Thereafter, in step 414, when one of the numbers of the third sequence signals and the fourth sequence signals is first counted to 3, this sequence signal is temporarily stored as the frame transformation signal template. When the sampling signal is the same as the frame transformation signal template, the frame transformation signal is generated, and the first chopper-stabilized signal is generated according to the frame transformation signal and the voltage polarity control signal. The first chopper-stabilized signal makes the OP amplifiers of the TFT LCD be properly and alternately switched between the first chopper-stabilized mode chopper-A and the second chopper-stabilized mode chopper-B so that the offset voltage is eliminated. FIG. 5B is a simple schematic illustration showing another example of the TFT LCD according to the preferred embodiment of the invention. As shown in FIG. 5B, the manner of voltage transformation of the voltage polarity inversion of the TFT LCD 500 is the two-line inversion, wherein the third sequence signal and the fourth sequence signal are defined as any two combinations exclusive of PPNNPPNN, NNPPNNPP, PNNPPNNP or NPPNNPPN.

After a predetermined period of time has elapsed, step 416 is entered. If the frame transformation signal template cannot be obtained, a second chopper-stabilized signal is generated according to the voltage polarity control signal. The second chopper-stabilized signal makes the OP amplifiers of the TFT LCD be properly and alternately switched between the first chopper-stabilized mode chopper-A and the second chopper-stabilized mode chopper-B so that the offset voltage is eliminated. FIG. 5C is a simple schematic illustration showing still another example of the TFT LCD according to the preferred embodiment of the invention. As shown in FIG. 5C, the voltage polarity inversion of the TFT LCD 500 is the two-line inversion or may be the one-line inversion. The TFT LCD 500 only has 1066 rows of pixels (i.e., (8y+2) rows of pixels), and the sampling signals obtained by sampling the voltage polarity control signal are the same. So, the frame transformation signal template cannot be obtained according to the sampling signals. That is, it is impossible to recognize whether the frame time period is changed. Thus, the outputted second chopper-stabilized signal makes the OP amplifier be switched between the first chopper-stabilized mode chopper-A and the second chopper-stabilized mode chopper-B with a specific order, such as ABABBABA or AABBBBAA, as long as an exchanged order, which is obtained after the front half portion of the specific order and the rear half portion of the specific order are exchanged, is reverse to the specific order.

Figure 6:
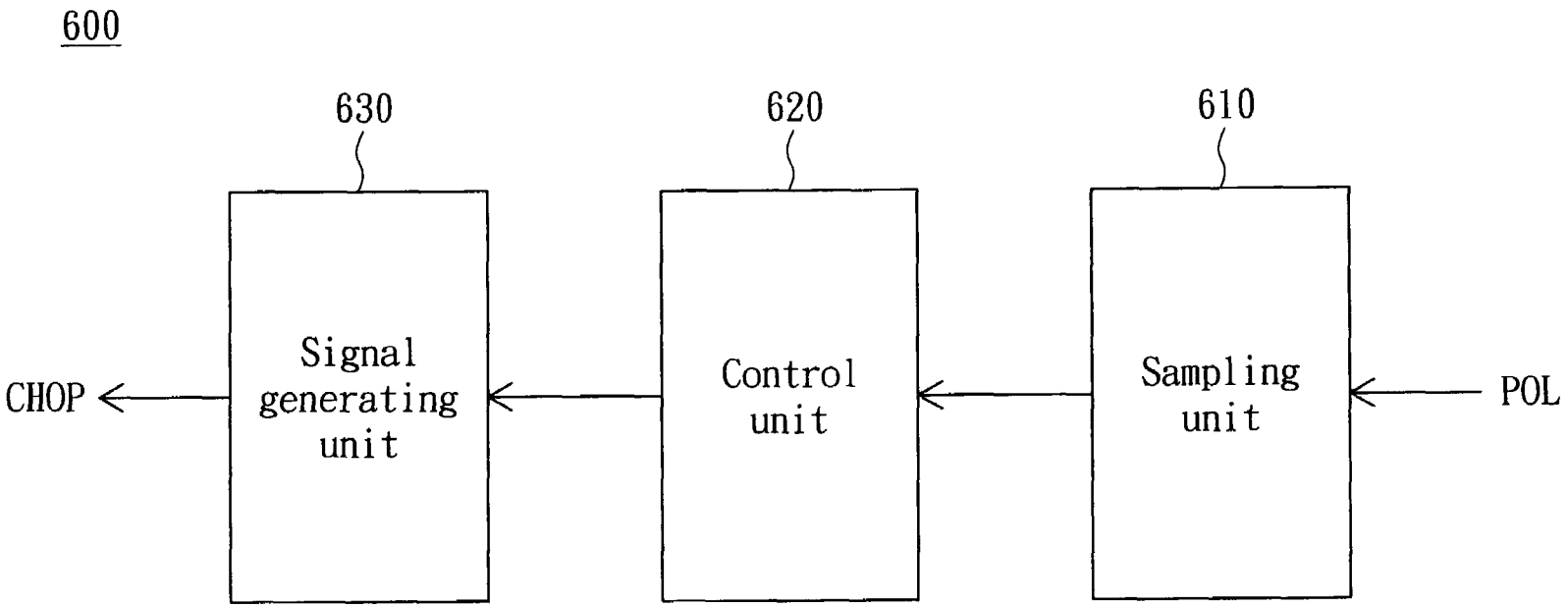
FIG. 6 is a block diagram showing an apparatus for generating the chopper-stabilized signals according to the preferred embodiment of the invention.

FIG. 6 is a block diagram showing an apparatus 600 for generating the chopper-stabilized signals according to the preferred embodiment of the invention. As shown in FIG. 6, the apparatus 600 is applied to a TFT LCD having many OP amplifiers. The apparatus 600 includes a sampling unit 610, a control unit 620 and a signal generating unit 630. The sampling unit 610 samples a voltage polarity control signal POL generated by a timing controller of the TFT LCD to obtain a sampling signal SS and judges a voltage transformation manner of the voltage polarity inversion of the voltage polarity control signal POL according to the sampling signal SS. The control unit 620 is coupled to the sampling unit 610. The signal generating unit 630 generates a first chopper-stabilized signal CHOP1 or a second chopper-stabilized signal CHOP2, and selects one of the first chopper-stabilized signal CHOP1 and the second chopper-stabilized signal CHOP2 as a chopper-stabilized signal CHOP to be outputted to the OP amplifier so that the OP amplifier can be properly switched between the first chopper-stabilized mode chopper-A and the second chopper-stabilized mode chopper-B.

Figure 7:
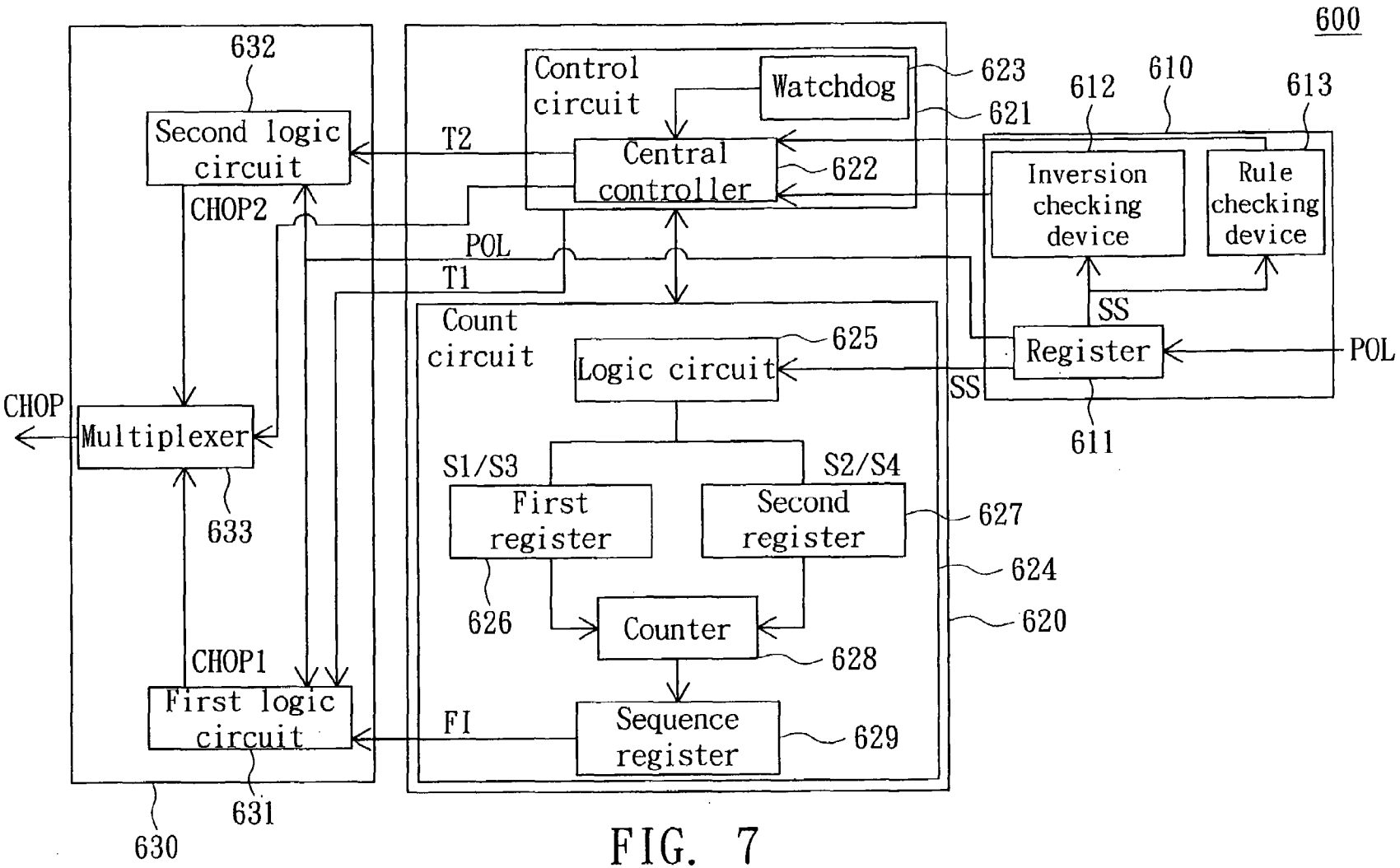
FIG. 7 is a detailed block diagram showing the apparatus for generating the chopper-stabilized signals according to the preferred embodiment of the invention.

FIG. 7 is a detailed block diagram showing the apparatus for generating the chopper-stabilized signals according to the preferred embodiment of the invention. Referring to FIG. 7, the apparatus 600 includes the sampling unit 610, the control unit 620 and the signal generating unit 630. The sampling unit 610 includes a register 611, an inversion checking device 612 and a rule checking device 613. The register 611 receives the voltage polarity control signal POL having several pulses. The register 611 continuously samples continuous n pulses of the voltage polarity control signal POL to obtain the sampling signal SS, wherein n is a positive integer and is usually equal to 8.

The inversion checking device 612 judges whether the voltage inversion of the voltage polarity control signal POL is the one-line inversion or the two-line inversion according to the sampling signal SS. When the control unit 620 cannot obtain a frame transformation signal template FI according to the voltage transformation manner of the voltage polarity inversion of the voltage polarity control signal POL and the sampling signal SS, the rule checking device 613 enables the control unit 620 to output a second trigger signal T2, and the signal generating unit 630 generates the second chopper-stabilized signal CHOP2 with a specific order according to the second trigger signal T2 in conjunction with the voltage polarity control signal POL.

The control unit 620 includes a control circuit 621 and a count circuit 624. The control circuit 621 outputs a first trigger signal T1 or the second trigger signal T2 to the signal generating unit 630. The count circuit 624 outputs the frame transformation signal template FI according to the voltage transformation manner of the voltage polarity inversion of the voltage polarity control signal POL and the sampling signal SS. The control circuit 621 includes a central controller 622 and a watchdog 623. The central controller 622 outputs the first trigger signal T1 or the second trigger signal T2 so that the signal generating unit 630 correspondingly generates the first chopper-stabilized signal CHOP1 or the second chopper-stabilized signal CHOP2.

In addition, if the count circuit 624 cannot obtain the frame transformation signal template FI after m frame time periods, wherein m is a positive integer greater than or equal to 20, the watchdog 623 enables the central controller 622 to output the second trigger signal T2, and the signal generating unit 630 generates the second chopper-stabilized signal CHOP2 with the specific order according to the second trigger signal T2 in conjunction with the voltage polarity control signal POL.

The count circuit 624 includes a first register 626, a second register 627, a logic circuit 625, a counter 628 and a sequence register 629. When the voltage transformation manner of the voltage polarity inversion of the voltage polarity control signal POL is the one-line inversion, the logic circuit 625 judges whether the sampling signal SS is a first sequence signal S1 or a second sequence signal S2. The first sequence signal and the second sequence signal are defined as any two combinations exclusive of PNPNPNPN or NPNPNPNP. If the sampling signal SS is the first sequence signal S1, the sampling signal SS is stored to the first register 626. If the sampling signal SS is the second sequence signal S2, the sampling signal SS is stored to the second, register 627. When the voltage transformation manner of the voltage polarity inversion of the voltage polarity control signal POL is the two-line inversion, the logic circuit 625 judges whether the sampling signal SS is a third sequence signal S3 or a fourth sequence signal S4, wherein the third sequence signal and the fourth sequence signal are defined as any two combinations exclusive of PPNNPPNN or PNNPPNNP or NNPPNNPP or NPPNNPPN. If the sampling signal SS is the third sequence signal S3, the sampling signal SS is stored to the first register 626. If the sampling signal SS is the fourth sequence signal S4, the sampling signal SS is stored to the second register 627.

The counter 628 counts the numbers of the first sequence signals S1 and the second sequence signals S2, or the numbers of the third sequence signals S3 and the fourth sequence signals S4. When one of the numbers of the first sequence signals S1 and the second sequence signals S2 is first counted to 3, or one of the numbers of the third sequence signals S3 and the fourth sequence signals S4 is first counted to 3, the sequence register 629 stores the corresponding sequence signal as the frame transformation signal template FI, and outputs the frame transformation signal template to the signal generating unit 630.

The signal generating unit 630 includes a first logic circuit 631, a second logic circuit 632 and a multiplexer 633. The first logic circuit 631 receives the first trigger signal T1 from the central controller 622, and compares the frame transformation signal template FI with the sampling signal SS. When the frame transformation signal template FI is the same as the sampling signal SS, a frame transformation signal is generated. The first logic circuit 631 generates the first chopper-stabilized signal CHOP1 according to the frame transformation signal and the voltage polarity control signal POL. The second logic circuit 632 receives the second trigger signal T2 from the central controller 622 and generates the second chopper-stabilized signal CHOP2 with a specific order. An exchanged order, which is obtained after the front half portion of the specific order and the rear half portion of the specific order are exchanged, is reverse to the specific order. The multiplexer 633 is coupled to the first logic circuit 631 and the second logic circuit 632, and is controlled by the central controller 622 to select one of the first chopper-stabilized signal CHOP1 or the second chopper-stabilized signal CHOP2 as the chopper-stabilized signal CHOP to be outputted to the OP amplifier.

According to the apparatus and the method for generating the chopper-stabilized signals, the problem of the offset voltage may be solved and the uniformity can be enhanced by making the OP amplifier be switched between the first chopper-stabilized mode and the second chopper-stabilized mode according to the voltage polarity control signal provided from the TFT LCD and without according to the start control signal.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A chopper-stabilized signal generating method, comprising the steps of:

(a) receiving a voltage polarity control signal;

(b) sampling the voltage polarity control signal to obtain a sampling signal, and judging a manner of voltage transformation of the voltage polarity inversion of the voltage polarity control signal according to the sampling signal, the manner of voltage transformation indicating a specific voltage polarity inversion for driving a display panel;

(c) obtaining a frame transformation signal template according to the manner of voltage transformation of the voltage polarity inversion of the voltage polarity control signal and the sampling signal, including judging whether the sampling signal is one of a plurality of sequence signals and counting the number of occurrences of the one of the sequence signals; and storing a specific one of the sequence signals as the frame transformation signal template when the number of occurrences of the specific one of the sequence signals is first counted to a predetermined number;

(d) comparing the frame transformation signal template with the sampling signal to generate a frame transformation signal; and (e) generating a first chopper-stabilized signal according to the frame transformation signal and the voltage polarity control signal.

2. The method according to claim 1, further comprising the step of:

(f) generating a second chopper-stabilized signal according to the voltage polarity control signal when the frame transformation signal cannot be obtained.

3. The method according to claim 1 being applied to a thin-film transistor (TFT) liquid crystal display (LCD), which has a plurality of OP amplifiers, wherein the first chopper-stabilized signal is outputted to the OP amplifiers.

4. The method according to claim 3, wherein the voltage polarity control signal is generated by a timing controller of the TFT LCD, and the voltage polarity control signal has a plurality of pulses.

5. The method according to claim 4, wherein the step (b) further comprises:

(b1) continuously sampling continuous n pulses of the voltage polarity control signal to obtain the sampling signal, wherein n is a positive integer; and (b2) judging a manner of voltage transformation of the voltage polarity control signal according to the sampling signal.

6. The method according to claim 5, wherein n is 8.

7. The method according to claim 5, wherein in the step (c), the specific voltage polarity inversion for driving the display panel is one-line inversion and the sequence signals includes a first sequence signal and a second sequence signals for one-line inversion.

8. The method according to claim 5, wherein in the step (c), the specific voltage polarity inversion for driving the display panel is two-line inversion and the sequence signals includes a third sequence signal and a fourth sequence signals for two-line inversion.

9. A chopper-stabilized signal generating method, comprising the steps of:

(a) receiving a voltage polarity control signal;

(b) sampling the voltage polarity control signal to obtain a sampling signal, and judging a manner of voltage transformation of the voltage polarity inversion of the voltage polarity control signal according to the sampling signal;

(c) obtaining a frame transformation signal template according to the manner of voltage transformation of the voltage polarity inversion of the voltage polarity control signal and the sampling signal;

(d) comparing the frame transformation signal template with the sampling signal to generate a frame transformation signal; and (e) generating a first chopper-stabilized signal according to the frame transformation signal and the voltage polarity control signal, wherein the method being applied to a thin-film transistor (TFT) liquid crystal display (LCD), which has a plurality of OP amplifiers, wherein the first chopper-stabilized signal is outputted to the OP amplifiers;

wherein the voltage polarity control signal is generated by a timing controller of the TFT LCD, and the voltage polarity control signal has a plurality of pulses;

wherein the step (b) comprises:

(b1) continuously sampling continuous n pulses of the voltage polarity control signal to obtain the sampling signal, wherein n is a positive integer; and (b2) judging a manner of voltage transformation of the voltage polarity control signal according to the sampling signal;

wherein the step (c) further comprises:

(c1) when the manner of voltage transformation of the voltage polarity inversion of the voltage polarity control signal is one-line inversion, judging whether the sampling signal is a first sequence signal or a second sequence signal and counting the numbers of occurrence of the first sequence signal and the second sequence signal; and (c2) temporarily storing the first sequence signal or the second sequence signal as the frame transformation signal template when the number of occurrences of the first sequence signal or the second sequence signal is first counted to 3 correspondingly.

10. A chopper-stabilized signal generating method, comprising the steps of:

(a) receiving a voltage polarity control signal;

(b) sampling the voltage polarity control signal to obtain a sampling signal, and judging a manner of voltage transformation of the voltage polarity inversion of the voltage polarity control signal according to the sampling signal;

(c) obtaining a frame transformation signal template according to the manner of voltage transformation of the voltage polarity inversion of the voltage polarity control signal and the sampling signal;

(d) comparing the frame transformation signal template with the sampling signal to generate a frame transformation signal; and (e) generating a first chopper-stabilized signal according to the frame transformation signal and the voltage polarity control signal, wherein the method being applied to a thin-film transistor (TFT) liquid crystal display (LCD), which has a plurality of OP amplifiers, wherein the first chopper-stabilized signal is outputted to the OP amplifiers;

wherein the voltage polarity control signal is generated by a timing controller of the TFT LCD, and the voltage polarity control signal has a plurality of pulses;

wherein the step (b) includes (b1) continuously sampling continuous n pulses of the voltage polarity control signal to obtain the sampling signal, wherein n is a positive integer; and (b2) judging a manner of voltage transformation of the voltage polarity control signal according to the sampling signal;

wherein the step (c) further includes (c3) when the manner of voltage transformation of the voltage polarity inversion of the voltage polarity control signal is two-line inversion, judging whether the sampling signal is a third sequence signal or a fourth sequence signal and counting the numbers of occurrence of the third sequence signal and the fourth sequence signal; and (c4) temporarily storing the third sequence signal or the fourth sequence signal as the frame transformation signal template when the number of occurrences of the third sequence signal or the fourth sequence signal is first counted to 3 correspondingly.

* * * * *